United States Patent [19]

Tanaka

[11] Patent Number: 4,983,941

[45] Date of Patent: Jan. 8, 1991

[54] ELECTROMAGNETICALLY OPERATED SWITCH

[75] Inventor: Toshinori Tanaka, Hemeji, Japan

[73] Assignee: Mitsubishi Denki Kabushiki Kaisha, Tokyo, Japan

[21] Appl. No.: 440,186

[22] Filed: Nov. 22, 1989

[30] Foreign Application Priority Data

Nov. 24, 1988 [JP] Japan ..... 63-152956

[51] Int. Cl.[5] ..... H01F 7/16; H01F 7/08; H01F 7/13

[52] U.S. Cl. ..... 335/255; 335/260

[58] Field of Search ..... 335/131, 126, 260, 255

[56] References Cited

U.S. PATENT DOCUMENTS

| | | | |
|---|---|---|---|
| 3,098,635 | 7/1963 | Delaporte et al. | 335/260 |
| 3,306,570 | 2/1967 | Cooksley | 335/255 |
| 3,447,773 | 6/1969 | Huber | 335/260 |
| 3,822,469 | 7/1974 | Lazenby | 335/255 |
| 4,450,423 | 7/1984 | Morishita . | |
| 4,520,332 | 5/1985 | Tagliafico | 335/126 |
| 4,677,407 | 2/1987 | Tanaka et al. . | |
| 4,847,580 | 7/1989 | Morishita et al. | 335/126 |

FOREIGN PATENT DOCUMENTS

| | | | |
|---|---|---|---|
| 0612293 | 1/1961 | Canada | 335/260 |
| 0483714 | 2/1970 | Switzerland | 335/126 |

*Primary Examiner*—Steven L. Stephan
*Assistant Examiner*—Nilay H. Vyas
*Attorney, Agent, or Firm*—Sughrue, Mion, Zinn, Macpeak & Seas

[57] ABSTRACT

An electromagnetically operated switch comprises a cylindrical bobbin having an exciting coil wound thereon; a fixed core arranged in the bobbin and a movable core arranged to confront the fixed core; a flange provided on the fixed core to expand outwardly in the radial direction and located on an end surface of the bobbin; a rod inserted in a through bore formed in the center of the fixed core; a flexible insulating sheet put on the end surface of the flange of the fixed core, having an opening in a central portion, and connected sealingly to the rod which extends through the opening; a cup-shaped cap mounted on the flange end surface to sandwich the sheet between the flange and the cap; and a movable contact supported by the rod in the cap.

6 Claims, 2 Drawing Sheets

ELECTROMAGNETICALLY OPERATED SWITCH

BACKGROUND OF THE INVENTION

1. Field of the Invention

The present invention relates to an electromagnetically operated switch, and more particularly to an electromagnetically operated switch which is applicable to a starter device for starting the engine of a vehicle.

2. Discussion of the Background

The electromagnetically operated switch in the starter device is used to drive a shift lever for sliding a pinion, and further to apply power to a D C motor of the starter device. Such electromagnetically operated switch is constructed as shown in FIG. 4.

The electromagnetically operated switch 1 includes a cylindrical casing 2 which has a wall 2a at its one end. In the casing 2 is arranged a cylindrical bobbin 4 which has an exciting coil 3 wound in its peripheral annular recess. In the bobbin 4 is engaged a sleeve 5, inside of which a fixed core 6 and a plunger 7 as a movable core are arranged to confront each other. The fixed core 6 is integrally provided with a flange 6a, which expands outwardly in the radial direction. The flange is in close contact with an end surface of the bobbin 4. A cup-shaped cap 8 is mounted to the end surface of the flange 6a remote from the bobbin 4, keeping its open end in close contact with the end surface. Between the open end of the cap 8 and the end surface of the flange 6a is interposed a ring-like rubber packing 9 to seal the joint portion of the flange 6a and the cap 8, thereby preventing gas evolved from the exciting coil 3 from invading the inside (contacting chamber) of the cap 8.

Fixing the cap 8 to the end surface of the flange 6a of the fixed core 6 has been made by putting the peripheral portion of the flange 6a and the peripheral portion 8a of the open end of the cap 8 in the casing 2 and bending the marginal portion of the casing 2 toward the end surface of the peripheral portion 8a of the cap 8 to crimp the marginal portion of the casing 2. In this way, the bobbin 4, the fixed core 6 and the cap 8 are fixed together to the casing 2.

At the central portion of the fixed core 6 is formed a through bore, in which a rod 10 is slidably inserted having its one end projected toward the plunger in a predetermined length. The other end of the rod 10 which projects in the inside of the cap 8 supports a movable contact 11. The cap 8 has a fixed contact 12 mounted thereon at a position where it can get in touch with the movable contact 11 when the rod 10 has been shifted.

In FIG. 4, reference numeral 13 designates a piston-shaped hook which is arranged to be slidable in a recess of the plunger 7, which opens outwardly in the axial direction. Reference numeral 14 designates a return spring which is arranged between the fixed core 6 and the plunger 7 in a compressed state. Reference numeral 15 designates a spring which urges the rod 10 to return it to a predetermined position.

When the electromagnetically operated switch is applied to the starter device, the switch could be generally splashed water by a wheel during the vehicle driving to be drenched owing to its mounting position (it is mounted to the engine). In this case, the conventional switch 1 can prevent the gas evolved from the exciting coil 3 from invading the contacting chamber because the packing 9 is sandwiched between the open end of the cap 8 and the flange end surface when the cap 8 is mounted to the flange end surface of the fixed core 6. However, the water which has gotten into the sleeve passes in the through bore of the fixed core 6 along the rod 10 and invades the inside of the cap 8. In general, the sleeve 5 and the return spring 14 are made of stainless steel or the like, the plunger 7 and the rod 10 are greased, and the fixed core 6 is plated. Although anti-corrosive treatment is given to some parts in this way, no treatment is given to the movable contact 11 and the fixed contact 12 in terms of conductivity, both contacts being made of copper.

As result, when water comes into the contacting chamber, the movable contact 11 or the fixed contact 12 will rust away, creating troubles wherein conduction becomes poor or the water causes a leak current.

SUMMARY OF THE INVENTION

It is an object of the present invention to eliminate the disadvantage of the conventional electromagnetically operated switch and to provide a new and improved electromagnetically operated switch capable of preventing water from invading the inside of a cap.

The foregoing and other objects of the present invention have been attained by providing an electromagnetically operated switch comprising a cylindrical bobbin having an exciting coil wound thereon; a fixed core arranged in the bobbin and a movable core arranged to confront to the fixed core; a flange provided on the fixed core to expand outwardly in the radial direction and located on an end surface of the bobbin; a rod inserted in a through bore formed in the center of the fixed core; a flexible insulating sheet put on the end surface of the flange of the fixed core, having an opening in a central portion, and connected sealingly to the rod which extends through the opening; a cup-shaped cap mounted on the flange end surface to sandwich the sheet between the flange and the cap; and a movable contact supported by the rod in the cap. As a result, even if the water which had invaded the inside of the sleeve has reached the flange along the rod through the bore of the fixed core under pumping action at the time of withdrawing the plunger, the water is prevented from invading the inside of the cap by the sheet, thereby avoiding wetting the contacts.

BRIEF DESCRIPTION OF THE DRAWINGS

A more complete appreciation of the invention and many of the attendent advantages thereof will be readily obtained as the same becomes better understood by reference to the following detailed description when considered in connection with the accompanying drawings, wherein.

DESCRIPTION OF THE PREFERRED EMBODIMENTS

Figure 1:
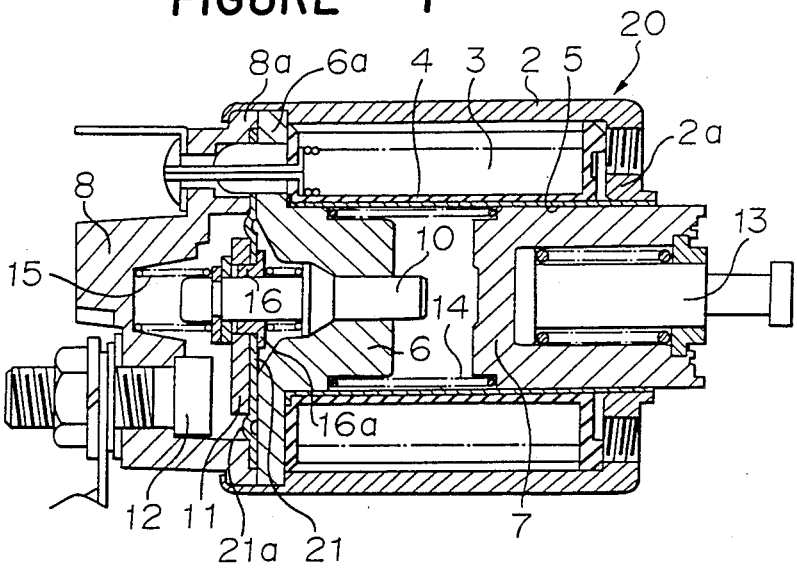
FIG. 1 is an axial sectional view of an embodiment of the electromagnetically operated switch according to the present invention.
Figure 4:
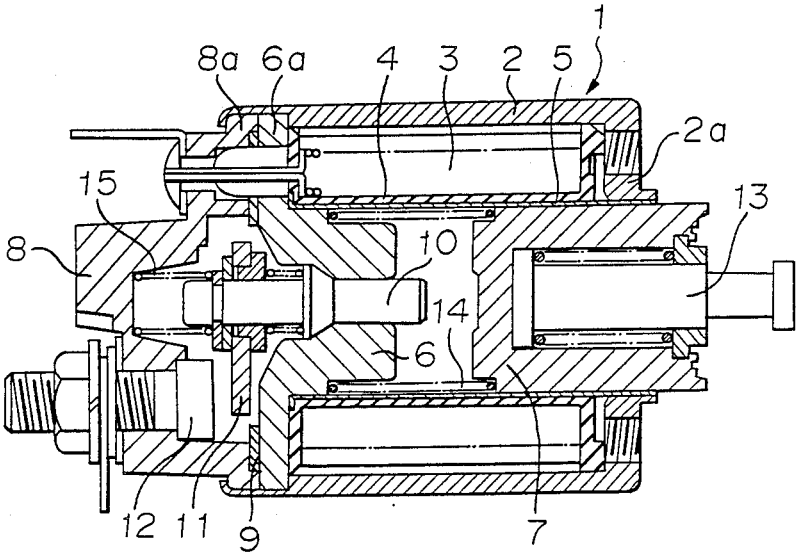
FIG. 4 is an axial sectional view of a conventional electromagnetically operated switch.

Referring now to the drawings, wherein like reference numerals designate identical or corresponding parts throughout the several views, and more particularly to FIG. 1 thereof, there is shown an electromagnetically operated switch 20 of a first embodiment according to the present invention. In FIG. 1 showing the first embodiment, parts similar or corresponding to those of the conventional electromagnetically operated switch of FIG. 4 are designated by the same reference numerals as FIG. 4. Explanation on these parts will be omitted for the sake of clarity.

In the electromagnetically operated switch 20 of the first embodiment, a rubber sheet 21 is arranged on the end surface of a flange of a fixed core 6. The sheet 21 has its marginal edge sandwiched between the open end of a cup-shaped cap 8 and the flange end surface of the fixed core 6. In the central portion of the sheet 21 is formed an opening through which a rod 10 is inserted.

Figure 2:
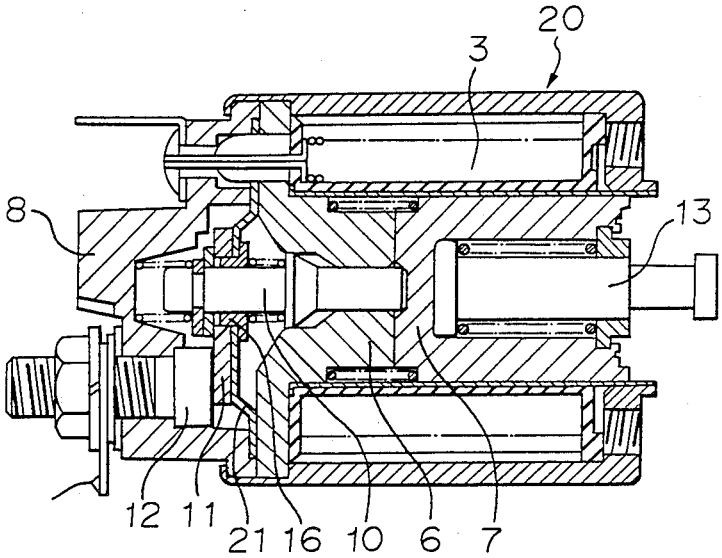
FIG. 2 is an axial sectional view showing how a fixed contact and a movable contact get in touch with each other at the time of attracting a plunger in the electromagnetically operated switch of FIG. 1.

A movable contact 11 is supported by the rod 10. Specifically, the movable contact 11 is attached to the peripheral surface of a cylindrical insulating supporter 16 which is engaged on the rod 10 so as to be slidable thereon. The supporter 16 is tightly inserted in the central opening of the sheet 21. The movable contact 11 is engaged on the peripheral portion of the supporter 16 at the side of the cap 8 with respect to the sheet 21. The sheet 21 has the inner circumferential portion of the opening firmly sandwiched between a flange 16*a* of the supporter 16 and the movable contact 11, the flange 16*a* being provided on the end portion of the supporter 16, which is located near to the fixed core 6. In this way, the sheet 21 is sealingly connected to the rod 10. The sheet 21 has a slack 21*a* in a portion near to the peripheral edge, so that when the rod 10 has been pushed in by the plunger 7, and the movable contact 11 has accordingly moved, the central portion of the sheet 21 can follow the movement of the movable contact as shown in FIG. 2.

In this way, the contacting chamber in the cap 8 where the movable contact 11 and the fixed contact 12 are arranged is effectively shielded from the fixed core 6 by the sheet 21. The water which has invaded along the rod 10 from the plunger 7 is prevented from coming into the inside of the cap 8 by the sheet 21. The water is exhausted outside through a gap between the sleeve and the plunger at the time of attracting the plunger.

Figure 3:
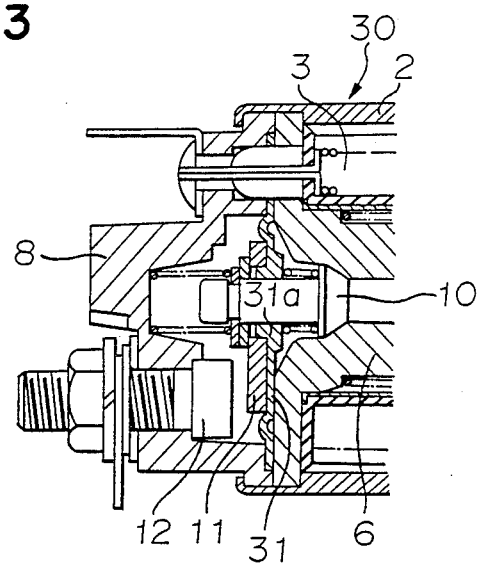
FIG. 3 is an axial sectional view of the essential parts of another embodiment of the electromagnetically operated switch of the present invention.

In FIG. 3, there is shown the electromagnetically operated switch 30 according to another embodiment of the present invention. In the electromagnetically operated switch 30 of the second embodiment, a rubber sheet 31 which functions to shield the inside of the cap 8 from the fixed core 6 has its central portion integrally provided with a supporter 31*a* for supporting the movable contact 11. In the opening which is formed at the center of the supporter 31*a*, the rod 10 is inserted to be slidable with respect to the supporter. The other parts are similar to those of the electromagnetically operated switch 20 of the first embodiment shown in FIG. 1.

Although the rubber sheet is used to isolate the inside of the cap 8 from the fixed core 6 in the first and second embodiments, any kind of flexible sheet is utilized provided that it has insulating property. The sheet may be provided with an air bleed aperture as required. In this case, the aperture is preferably formed at a portion closest to the center of the sheet in order to prevent water from coming into the inside of the cap. This is because the water which has arrived at the flange along the rod 10 through the bore of the fixed core 6 has the tendency to invade the inside of the cap 8 along the wall surface.

Obviously, numerous modifications and variations of the present invention are possible in light of the above teachings. It is therefore to be understood that within the scope of the appended claims, the invention may be practiced otherwise than as specifically described herein.

What is claimed is:

1. An electromagnetically operated switch comprising:
   - a cylindrical bobbin having an exciting coil would thereon;
   - a fixed core arranged in the bobbin and a movable core arranged to confront the fixed core;
   - a flange provided on the fixed core to expand outwardly in the radial direction and located on an end surface of the bobbin;
   - a rod inserted in a through bore formed in the center of the fixed core;
   - a flexibly insulating sheet put on the end surface of the flange of the fixed core, having an opening in a central portion, and connected sealingly to the rod which extends through the opening, wherein said sheet is provided with an air bleed aperture;
   - a cup-shaped cap mounted on the flange end surface to sandwich the sheet between the flange and the cap; and
   - a movable contact supported by the rod in the cap.

2. A switch according to claim 1, wherein the sheet is of rubber.

3. A switch according to claim 1, wherein the marginal edge of the sheet is sandwiched at the location where the open end of the cap and the flange end surface of the fixed core are in contact with each other.

4. A switch according to claim 1, wherein the sheet has slack in a portion near to the peripheral edge.

5. A switch according to claim 1, wherein the sheet has its central portion integrally provided with a supporter for supporting the movable contact.

6. A switch according to claim 1, wherein the aperture is formed at a position closest to the center of the sheet.

* * * * *